United States Patent [19]

Hirose

[11] Patent Number: 4,544,227

[45] Date of Patent: Oct. 1, 1985

[54] SHIELDED ELECTRICAL CONNECTOR

[75] Inventor: Takao Hirose, Mibu, Japan

[73] Assignee: Allied Corporation, Morris Township, Morris County, N.J.

[21] Appl. No.: 409,479

[22] Filed: Aug. 19, 1982

[30] Foreign Application Priority Data

Sep. 3, 1981 [JP] Japan ..... 56-130370[U]

[51] Int. Cl.[4] ..... H01R 13/648

[52] U.S. Cl. ..... 339/143 R

[58] Field of Search ..... 339/143 R, 136 R, 136 M, 339/14 R

[56] References Cited

U.S. PATENT DOCUMENTS

| | | | |
|---|---|---|---|
| 3,128,138 | 4/1969 | Noschese | 339/14 R |
| 3,587,029 | 6/1971 | Knowles | 339/14 R |
| 3,744,128 | 7/1973 | Fisher et al. | 29/629 |
| 3,897,125 | 7/1975 | Anderson | 339/14 L |
| 4,337,989 | 7/1982 | Asick et al. | 339/143 R |
| 4,386,814 | 6/1983 | Asick | 339/143 R X |
| 4,389,080 | 6/1983 | Clark et al. | 339/143 RC X |

FOREIGN PATENT DOCUMENTS

| | | |
|---|---|---|
| 2317538 | 12/1972 | France . |
| 2360191 | 2/1978 | France . |

*Primary Examiner*—Eugene F. Desmond

*Attorney, Agent, or Firm*—Roger H. Criss

[57] ABSTRACT

An electrical connector in which the male portion (1) is provided with a shield metal spring (8) to make an electrical connection to a metal shell (2) and its connecting section (8*a*) bridges over to the insulation housing (1*a*). The female portion (4) is provided with a metal shell (9) having a metal side section (9*b*) for contact with the shield metal spring (8) and the metal connecting section (8*a*) that is connected to a metal panel (5). When the parts are mated, the male portion metal shell (2) is automatically electrically connected to the metal panel (5).

6 Claims, 10 Drawing Figures

FIG. 1(a)
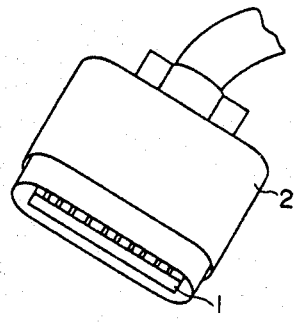
FIG. 1(b)
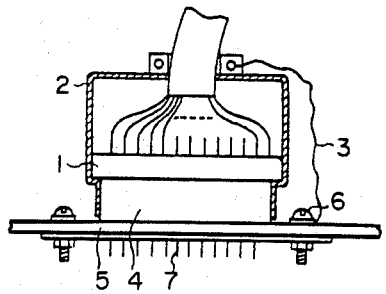
FIG. 2
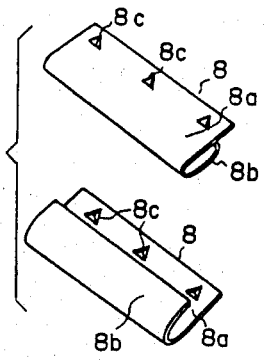
FIG. 3(a)
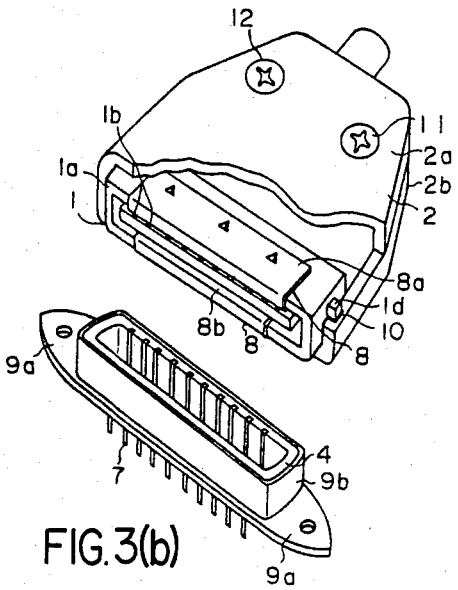
FIG. 3(b)

FIG. 4
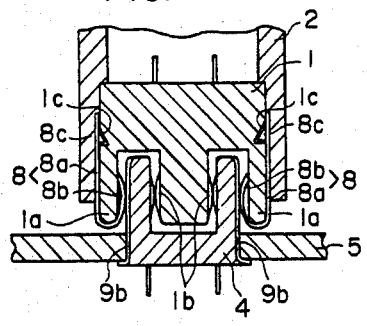
FIG. 5
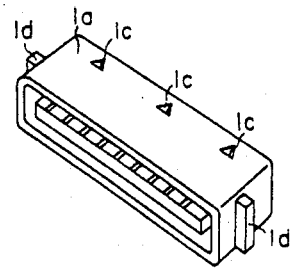
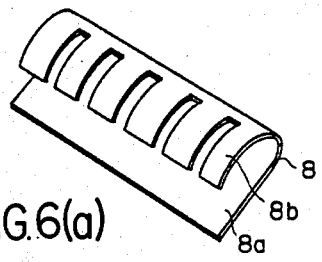
FIG. 6(a)
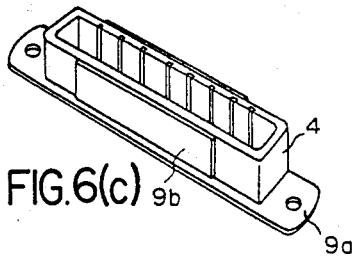
FIG. 6(c)
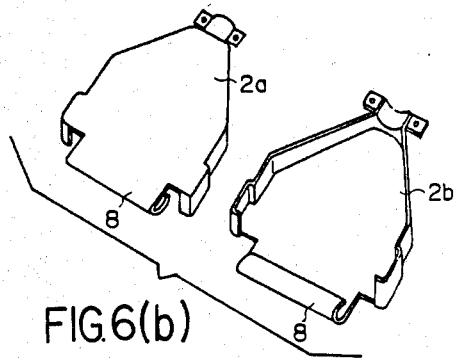
FIG. 6(b)

SHIELDED ELECTRICAL CONNECTOR

BACKGROUND OF THE INVENTION

1. Field of the Invention

This invention relates to shielded electrical connectors.

2. Description of the Prior Art

Due to the remarkable progress of the microcomputer and other similar types of electronic equipment which depend upon the amplification and processing of low amplitude data signals and the increase in the demand for such equipment, there are many multi-contact electrical connectors in use for interconnecting the microcomputer or other equipment with signal input-/output terminals. However, as is well known, equipment of this kind is oftentimes vulnerable to noise signals (such as EMI and EMP interference) which can produce errors in the processing of the low amplitude data signals. Thus, any noise signals that are picked up by an electrical connector used in such systems can become troublesome. Therefore, in the past, for example as shown in the perspective view of FIGS. 1A and 1B of the accompanying drawings (both figures being designated as depicting prior art) one of the connectors, e.g., the upper body portion of male connector 1, is covered with a metal shell 2 and a small diameter electrically conductive grounding wire 3 is used to connect the shell through the agency of a fastening screw 6, to the metal panel 5 for grounding the shell to the panel. The male connector 1 is shown mated with the female connector 4 which is in turn mounted on the metal panel 5. The contacts within the female connector 4 which mate with contacts carried by male connector 1 are provided with some form of wire termination tails, such as pin 7.

However, as tests have shown, because the above-mentioned grounding wire 3 itself acts to pick up noise signals, the shielding provided by the metal shell 2 is not completely effective. Also, the grounding wire 3 must be connected or disconnected to and from either the metal panel 5 or the shell 2 each time the female and male connectors are mated or unmated. Because of this, the mating and unmating operations become cumbersome. Additionally, because the grounding wire is exposed outside the connector, it may disturb the aesthetic design harmony of the equipment of which the panel is a part.

SUMMARY OF THE INVENTION

In accordance with this invention, a male and female connector pair are provided with a low-cost shielding arrangement, which obviates the above-mentioned faults so as to provide effective, reliable shielding against noise signals even after such connectors have been repeatedly mated and unmated.

In accordance with the present invention, there is provided a first electrical connector adapted for shielded intermating with a second electrical connector having a body of dielectric material supporting a first set of electrical contacts, with the outer peripheral surface of the dielectric body being snugly surrounded at least in part by an electrically conductive grounding shell, the first electrical connector having a body of dielectric material supporting a second set of electrical contacts adapted to be mated with the first set of electrical contacts, the first electrical connector being characterized in that an electrically conductive housing shell member surrounds a substantial portion of the outer peripheral surface of the first connector dielectric body, the dielectric body having a recess in the mating face thereof for receiving the second electrical connector and a conductive spring shield member held by the shell member and electrically connected thereto extending from the shell member along the peripheral surface of the first connector dielectric body towards the mating face thereof and around the outer edge of the recess therein into and along the inner wall of the recess so that the shell of the first connector is electrically connected to the grounding shell of the second connector when the two connectors are intermated.

BRIEF DESCRIPTION OF THE DRAWINGS

FIG. 1A is a perspective view of a prior art shielded male connector.

FIG. 1B is a plan view partly in cross-section of the connector shown in FIG. 1A and mated to a prior art female connector.

FIG. 2 is a perspective view showing in the upper part one side of a spring shield member in accordance with the present invention and the lower part the other side of the spring shield member.

FIG. 3A is a partially cut away perspective view of a male connector in accordance with the present invention.

FIG. 3B is a perspective view of a female connector in accordance with the present invention.

FIG. 4 is a cross-sectional view showing the male and female connectors of FIGS. 3A and 3B fully mated with one another.

FIG. 5 is a perspective view of the dielectric body held within the male connector shown in FIG. 3A.

FIG. 6A is a perspective view of another form of spring shield member in accordance with the present invention.

FIG. 6B is a perspective view of the two halves of an alternative form of housing for a male connector in accordance with the present invention.

FIG. 6C is a perspective view of a female connector body having an outer housing member different from that shown in FIG. 3B.

DESCRIPTION OF THE PREFERRED EMBODIMENTS

Referring to FIG. 2, in accordance with the present invention, two pieces of U-shaped spring shield member 8 are provided consisting of a flat connecting section **8*a* and an arc-shaped contact section 8*b*. As shown in FIGS. 3A and 3B, connecting section 8*a* is sandwiched by metal housing shell 2 and male connector body 1 so as to become electrically connected to metal shell 2. Contact section 8*b* is placed so as to face the contacts 1*b* of the male connector and to bridge the mating edging of the recess in insulation housing 1*a*. On the other hand, the female connector body 4 is provided with a metal shell 9 as shown in FIG. 3B, consisting of a mounting section 9*a* that connects to the metal panel 5, and a metal side section 9*b*. As shown in FIG. 4, when the female and male connectors are mated, the contact section 8*b* of the spring shield member 8 makes contact with the metal side section of the female connector's metal shell 9. Thus, the metal shell 2 of the male connector is connected to the metal panel 5 via the connecting metal section 9*a***.

In this manner, the metal shell of the male connector is connected to the metal panel automatically when mating takes place, and unlike prior art connectors, this mating is not burdened with the cumbersome use of a small diameter wire. Furthermore, a simple and secure shielding of the connectors is provided. Also, the shield metal spring 8 is secured in a manner as will now be described. Namely, as shown in FIG. 2 the outstruck tangs 8*c* are made in the spring shield member 8 which are fitted into the position controlling indentations 1*c* that are made in both surfaces of the male dielectrical body 1 (as indicated in FIGS. 4 and 5) to secure the shield member in the direction of mating insertion. Also, as shown in FIG. 5, the fastening projections 1*d* that are made to the left and right hand sides of the male dielectric body 1 are to be fitted into the connector fastening indentations 10 that are provided to the left and right hand sides of the housing shell parts 2*a* and 2*b* as shown in FIG. 3A. After the housing shell parts 2*a* and 2*b* are fitted together, screws 11 and 12 are placed into threaded holes in one of the housing shell parts and screwed into these holes to thereby fasten the two shell parts together. Thus, the shield metal spring 8 is sandwiched and secured.

The shell 2 can be made of synthetic resin or plastic that is vacuum metal coated, electroplated or painted with an electrically conducting material. In such a case, for example, metal plating can be made only to the inner surface where it makes contact with the metal spring shield member 8.

The electrical contact with the female connector's metal shell can be further improved by forming the contact section 8*b* of the spring shield member 8 into a comb configuration as shown in FIG. 6. Each of the teeth on the comb is bent in an arcuate manner to provide a spring action as shown in FIG. 2. Also in FIG. 2, the spring shield member 8 was made independently and thereafter fastened between the dielectric body and the housing of the male connector. However, as shown in FIG. 6*b*, metal shells 2*a* and 2*b* have the shield member 8 made as an integral part and after the contact section 8*b* of the shield 8 is inserted into the recess 1*a* of the dielectric body so as to face the contact held therewithin, the shells are secured to one another to hold the male dielectric body. Also, as shown in FIG. 6*c*, a metal side-section 9*b* can be provided to partially extend on the outer wall of the female connector body 4 to enhance electrical interconnection of the two connectors.

Further, metal shell hardware can be produced separately from the rest of the connector parts and thereafter fitted to the female connector body. It is noted that where the shield members are made separately and assembled as described in FIG. 3*a* by removing the shield and by replacing the metal housing with a synthetic resin shell, the connector may be converted to the conventional type of electrical connector where shielding is not required.

I claim:

1. A first electrical connector adapted for shielded intermating with a second electrical connector where the second electrical connector has a body of dielectric material having an elongated rectangular shape and supporting a first set of electrical contacts, with the outer peripheral surface of the dielectric body being surrounded by an electrically conductive grounding shell, said first electrical connector having a body of dielectric material supporting a second set of electrical contacts adapted to be mated with the first set of electrical contacts, said first electrical connector being characterized in that an electrically conductive housing shell member surrounds a substantial portion of the outer peripheral surface of the first connector dielectric body, said dielectric body having an elongated rectangular shape and an elongated rectangular recess in the mating face thereof for receiving said second electrical connector and two elongated conductive spring shield members separate from said shell and held by said shell member and electrically connected thereto arranged oppositely and extending from said shell member along the respective peripheral surface of said first connector dielectric body towards the mating face thereof and around the outer edge of the recess therein into and along the inner wall of the recess so that the shell of the first connector is electrically connected to the grounding shell of the second connector when the two connectors are intermated, each of said spring shield members having a flat connecting section which is placed in close juxtaposition to the outer peripheral surface of said first connector dielectric body and an arcuate contact section which bridges the mating end surface of the wall surrounding said recess and extends into the recess against the inner wall thereof, a portion of said flat connecting section being sandwiched between the inner surface of said shell and the outer surface of said dielectric body to hold said spring shield member against said dielectric body.

2. A connector according to claim 1 wherein said spring shield member has positioning tangs extending from one surface of the connecting section thereof which engage indentations in the outer surface of said dielectric body to restrain movement between said shield member and said dielectric body.

3. A connector according to claim 1 wherein the arcuate portion of said spring shield member is slotted in the form of a comb with the teeth of said comb forming individual spring contact members which are spring biased against the grounding shell of the second connector when both connectors are intermated with one another.

4. A connector according to claim 1 wherein the dielectric body of the second connector has a recess in the mating face thereof with the electrical contacts supported therein positioned against the peripheral wall of said recess and wherein the recess of said first connector dielectric body has a centrally positioned contact supporting wall member extending from the bottom of the recess toward the mating face of the first connector dielectric body with the contacts supported thereby lying against the peripheral surface of said contact supporting wall.

5. A connector according to claim 1 wherein the dielectric body of the first connector is provided with outwardly extending fastening projections which engage fastening indentations on the inner surface of the housing shell member.

6. A first electrical connector adapted for shielded intermating with a second electrical connector where the second electrical connector has a body of dielectric material having an elongated rectangular shape and supporting a first set of electrical contacts, with the outer peripheral surface of the dielectric body being snugly surrounded at least in part by an electrically conductive grounding shell, said first electrical connector having a body of dielectric material supporting a second set of electrical contacts adapted to be mated with the first set of electrical contacts, said first electrical connector being characterized in that an electrically conductive housing shell member surrounds a substantial portion of the outer peripheral surface of the first connector dielectric body, said dielectric body having an elongated rectangular shape and an elongated rectangular recess in the mating face thereof for receiving said second electrical connector and an elongated conductive spring shield member held by said shell member and electrically connected thereto extending from said shell member along the peripheral surface of said first connector dielectric body towards the mating face thereof and around the outer edge of the recess therein into and along the inner wall of the recess so that the shell of the first connector is electrically connected to the grounding shell of the second connector when the two connectors are intermated; said conductive spring shield member being a member separate from said shell and having a flat connecting section which is placed in close juxtaposition to the outer peripheral surface of said first connector dielectric body and an arcuate contact section which bridges the mating end surface of the wall surrounding said recess and extends into the recess against the inner wall thereof, a portion of said flat connecting section being sandwiched between the inner surface of said shell and the outer surface of said dielectric body to hold said spring shield member against said dielectric body, said spring shield member having positioning tangs extending from one surface of the connecting section thereof which engage indentations in the outer surface of said dielectric body to restrain movement between said shield member and said dielectric body.

* * * * *